US007854830B2

(12) United States Patent
Rao et al.

(10) Patent No.: US 7,854,830 B2
(45) Date of Patent: Dec. 21, 2010

(54) SYSTEM AND METHOD FOR ELECTROPLATING METAL COMPONENTS

(75) Inventors: Garimella Balaji Rao, Glendale Park (SG); Maarten Gerard Pieter Rijs, Amsterdam (NL)

(73) Assignee: United Technologies Corporation, Hartford, CT (US)

( * ) Notice: Subject to any disclaimer, the term of this patent is extended or adjusted under 35 U.S.C. 154(b) by 899 days.

(21) Appl. No.: 11/788,609

(22) Filed: Apr. 20, 2007

(65) Prior Publication Data

US 2008/0202938 A1 Aug. 28, 2008

(51) Int. Cl.
*C25D 7/00* (2006.01)

(52) U.S. Cl. ..... 205/145; 204/199

(58) Field of Classification Search ..... 204/198, 204/199, 212; 205/137, 145
See application file for complete search history.

(56) References Cited

U.S. PATENT DOCUMENTS 2,085,730 A * 7/1937 Cox et al. ..... 204/200
3,664,944 A * 5/1972 Buckley ..... 204/212
4,768,924 A 9/1988 Carrier et al.
5,476,363 A 12/1995 Freling et al.
6,296,447 B1 10/2001 Rigney et al.
6,306,277 B1 10/2001 Strangman et al.
6,387,541 B1 5/2002 Gray et al.
6,395,406 B1 5/2002 Sangeeta
6,428,602 B1 8/2002 Rosenzweig et al.
6,609,894 B2 8/2003 Jackson et al.
6,935,840 B2 8/2005 Romani et al.
7,023,307 B2 4/2006 Dooley
7,140,952 B1 11/2006 Juneau et al.
7,157,114 B2 1/2007 Ackerman et al.

* cited by examiner

*Primary Examiner*—Luan V Van
(74) *Attorney, Agent, or Firm*—Kinney & Lange, P.A.

(57) ABSTRACT

A system and a method for electroplating a plurality of turbine blades, comprising providing a rotatable gear for each blade, operatively connecting a mount assembly for each gear, slidably placing an electric charge on the blades.

17 Claims, 5 Drawing Sheets

SYSTEM AND METHOD FOR ELECTROPLATING METAL COMPONENTS

CROSS-REFERENCE TO RELATED APPLICATION(S)

This application claims priority of Singapore Patent Application No. 200701366-7, filed on Feb. 27, 2007, and entitled "SYSTEM AND METHOD FOR ELECTROPLATING METAL COMPONENTS".

BACKGROUND

The present invention relates to systems and methods for electroplating metal components, such as aerospace components. In particular, the present invention relates to systems and methods for rotating metal components during electroplating processes, thereby improving the uniformity of plated metal coatings.

Gas turbine engine components (e.g., turbine blades and vanes) are exposed to extreme temperatures and pressures during the course of operation. Such components are typically electroplated with metal coatings to protect the underlying components during operation. Electroplating techniques typically involve placing the engine component in a bath of a plating solution, and inducing a current through the engine component and the plating solution. The current causes positive-charged metallic ions of the plating solution to deposit onto the negatively-charged engine components, thereby forming plated metal coatings.

The uniformity of a plated metal coating (e.g., thickness and density) is important to properly protect an underlying component. As a result, electroplating processes typically require continuous monitoring and adjustments to ensure that uniform metal coatings are formed on the engine components. Such monitoring and adjustments are tedious and cumbersome to perform. Thus, there is a need for a system and method for electroplating metal components that are easy to use and provide substantially uniform metal coatings.

SUMMARY

The present invention relates to a system and method for electroplating a metal component. The system includes a rotatable gear, a mount assembly secured to the gear for retaining the metal component, and a conductive contact secured for placing electric charge on the retained metal component during an electroplating process.

DETAILED DESCRIPTION

Figure 1:
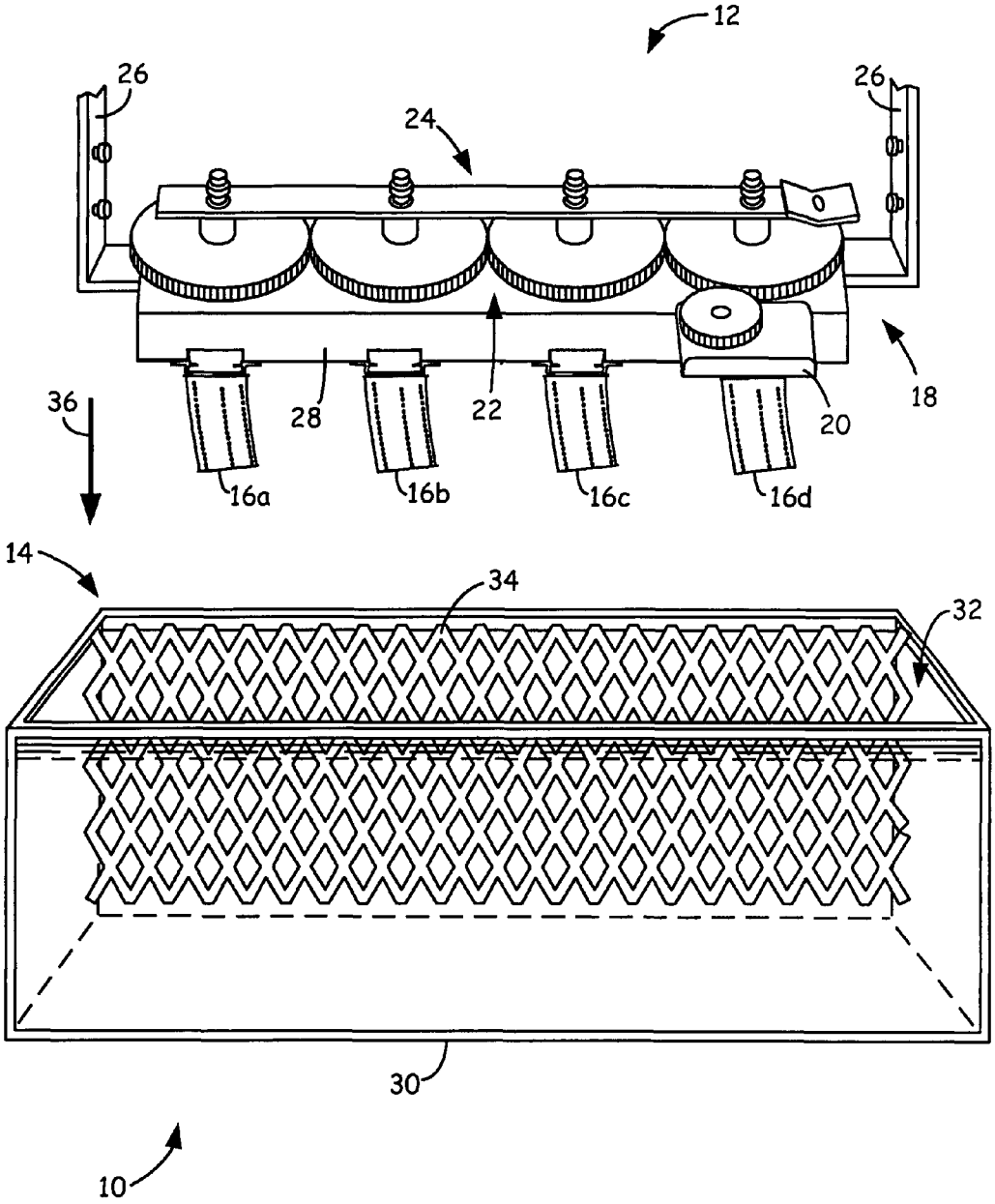
FIG. 1 is a perspective view of an electroplating system of the present invention, showing a rotator assembly disposed above a plating bath.

FIG. 1 is a perspective view of system 10, which is an electroplating system that includes rotator assembly 12 and plating bath 14, where rotator assembly 12 is disposed above plating bath 14. As shown, rotator assembly 12 retains blades 16*a*-16*d*, and includes frame 18, motor 20, gear assembly 22, and cathode assembly 24. Blades 16*a*-16*d* are turbine blades undergoing an electroplating process to receive a plated metal coating. While system 10 is particularly suitable for electroplating turbine engine components (e.g., turbine blades and vanes), system 10 may be used with any metal component that requires an electroplated metal coating.

Frame 18 of rotator assembly 12 includes support arms 26 and base platform 28 secured to support arms 26. Base platform 28 is desirably formed from a non-conductive material (e.g., plastics) to electrically isolate cathode assembly 24 from motor 20 and support arms 26. As used herein, the term "conductive" refers to electrical conductivity. Frame 18 desirably allows rotator assembly 12 to be lowered and raised, thereby respectively immersing and removing blades 16*a*-16*d*, into and from, plating bath 14. In alternative embodiments, frame 18 may include different structural components that allow rotator assembly 12 to be raised and lowered, manually or in an automated manner, relative to plating bath 14.

Motor 20 is a drive motor for operating gear assembly 22. As discussed below, gear assembly 22 is mounted on base platform 28, and blades 16*a*-16*d* are mounted to gear assembly 22 such that blades 16*a*-16*d* extend below base platform 28. Accordingly, the operation of gear assembly 22 via motor 20 rotates blades 16*a*-16*d* during an electroplating process. This allows a metal coating having a substantially uniform thickness and density to be formed on each of blades 16*a*-16*d*.

Cathode assembly 24 is a conductive contact portion of rotator assembly 12, and is supported by gear assembly 22. Cathode assembly 24 is also conductively connected to blades 16*a*-16*d* when blades 16*a*-16*d* are mounted to gear assembly 22. During an electroplating process, cathode assembly 24 is also connected to a negative terminal of a battery or other direct-current (DC) source (not shown), thereby placing a negative charge on cathode assembly 24. This correspondingly places negative charges on blades 16*a*-16*d*. Suitable alternative DC sources include controllers that provide continuous plating currents or pulsed DC currents.

Plating bath 14 includes bath container 30, plating solution 32, and anode mesh 34, where bath container 30 is a fluid-holding structure that contains plating solution 32 and anode mesh 34. Plating solution is a metal-salt solution containing a metal used for an electroplating process. The particular metal used depends on the desired plated metal coating that will be formed on blades 16*a*-16*d*. Examples of suitable electroplating metals include platinum, silver, nickel, cobalt, copper, aluminum, and combinations thereof, with particularly suitable electroplating metals for turbine engine components including platinum and aluminum. As used herein, the term "solution" refers to any suspension of particles in a carrier fluid (e.g., water), such as dissolutions, dispersions, emulsions, and combinations thereof.

Anode mesh 34 is a conductive metal wall that is connected to a positive terminal of a battery or other DC source (not shown), thereby placing a positive charge within plating solution 32 during an electroplating process. As discussed above, suitable alternative DC sources include controllers that provide continuous plating currents or pulsed DC currents. In alternative embodiments, plating bath 14 may include two or more anode walls, which further distribute the positive charge within plating solution 32. For example, a second anode mesh (not shown) may be disposed parallel to anode mesh 34 adjacent the opposing wall of bath container 30. Furthermore, an additional anode mesh (not shown) may be disposed on the bottom of bath container 30, perpendicular to the pair of parallel anode meshes. Many other arrangements of anode mesh 34 are also possible.

During an electroplating process, blades 16*a*-16*d* are mounted to gear assembly 22 of rotator assembly 12, below base platform 28. Rotator assembly 12 is then lowered down toward plating bath 14 (in the direction of arrow 36) until blades 16*a*-16*d* are at least partially immersed in plating solution 32. Rotator assembly 12 is desirably lowered until base platform 28 is disposed at the surface of, or partially immersed in, plating solution 32. This fully immerses blades 16*a*-16*d* within plating solution 32, while also preventing the components above base platform 28 (e.g., gear assembly 22 and cathode assembly 24) from being immersed.

After blades 16*a*-16*d* are immersed, motor 20 then causes gear assembly 22 to continuously rotate blades 16*a*-16*d* within plating solution 32. A negative charge is then placed on cathode assembly 24 and a positive charge is placed on anode mesh 34. Because blades 16*a*-16*d* are in conductive contact with cathode assembly 24, negative charges are also placed on blades 16*a*-16*d*. The positive charge placed on anode mesh 34 causes the metal-salts of plating solution 32 to disassociate, thereby forming positive-charged metallic ions in the carrier fluid. The negative charge placed on blades 16*a*-16*d* attracts the metallic ions, and reduces the positive charges on the metallic ions upon contact with blades 16*a*-16*d*. This forms metal coatings bonded to blades 16*a*-16*d*.

As shown in FIG. 1, anode mesh 34 is disposed adjacent the rear side of bath container 30. As such, when rotator assembly 12 is lowered toward plating bath 14, anode mesh 34 is correspondingly disposed adjacent one side of the immersed blades 16*a*-16*d*. If blades 16*a*-16*d* remained motionless (i.e., non-rotated), a greater amount of metallic ions would deposit onto the surfaces of blades 16*a*-16*d* that face anode mesh 34 compared to the surfaces that do not face anode mesh 34. This would result in non-uniform coatings formed on blades 16*a*-16*d*, which may reduce the effectiveness of the resulting metal coatings.

In contrast, the rotational motion applied to blades 16*a*-16*d* by rotator assembly 12 evenly distributes the amount of time each surface of each blade faces anode mesh 34. This increases the uniformity of the plated metal coatings formed on blades 16*a*-16*d* without requiring manual monitoring or adjustments. Additionally, system 10 allows multiple metal components (e.g., blades 16*a*-16*d*) to be plated in a single electroplating process, thereby reducing the throughput time required to manufacture the metal components.

Figure 2:
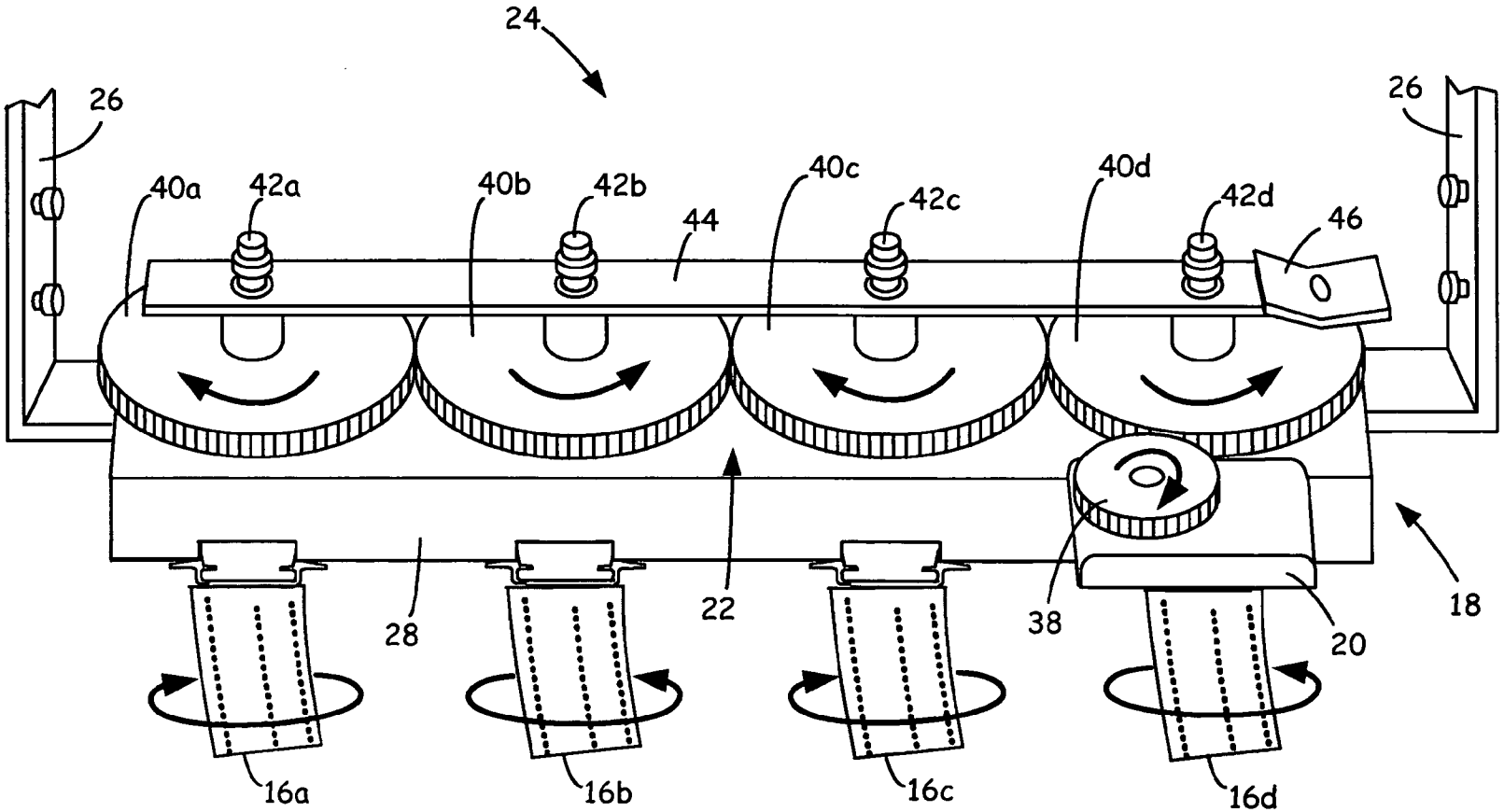
FIG. 2 is an expanded perspective view of the rotator assembly of the electroplating system.

FIG. 2 is an expanded view of rotator assembly 12, further illustrating gear assembly 22 and cathode assembly 24. As shown, gear assembly 22 includes reducing gear 38 and blade-rotating gears 40*a*-40*d*. Reducing gear 38 is a rotatable gear axially connected to motor 20, which allows motor 20 to rotate reducing gear 38. Reducing gear 38 also engages gear 40*d*, thereby allowing reducing gear 38 to correspondingly rotate gear 40*d* when motor 20 rotates reducing gear 38.

Gears 40*a*-40*d* are a series of engaged rotatable gears, which allows a given gear in the series (e.g., gear 40*b*) to be driven by the previous gear in the series (e.g., gear 40*c*), and also allows the given gear to drive the successive gear in the series (e.g., gear 40*a*). Consequentially, reducing gear 38 provides rotational power to rotate each gear of gears 40*a*-40*d*, as represented by the rotational arrows on reducing gear 38 and gears 40*a*-40*d*. This correspondingly rotates blades 16*a*-16*d* in the same rotational directions as gears 40*a*-40*d*, respectively. Alternatively, motor 20 may rotate reducing gear 38 in an opposite rotational direction, thereby rotating gears 40*a*-40*d* and blades 16*a*-16*d* in opposite rotational directions from those shown in FIG. 2.

Blades 16*a*-16*d* rotate at about the same rotational speeds because gears 40*a*-40*d* have about the same diameters. Examples of suitable rotational speeds for gears 40*a*-40*d* and blades 16*a*-16*d* range from about 10 rotations-per-minute (rpm) to about 40 rpm, with particularly suitable rotational speeds ranging from about 20 rpm to about 25 rpm. In alternative embodiments, one or more gears in the series (e.g., gears 40*a*-40*d*) may have different diameters from other gears in the series. In these embodiments, the gears having smaller diameters rotate at higher rotational speeds compared to the larger-diameter gears. As such, during an electroplating process, one or more of the metal components (e.g., turbine blades and vanes) may be rotated at different rotational speeds from the other metal components. This increases the versatility of system 10, and allows users to customize the electroplating process.

Reducing gear 38 and gears 40*a*-40*d* are desirably formed from non-conductive material (e.g., plastics) to further electrically isolate cathode assembly 24 from motor 20 and support arms 26. While gear assembly 22 is shown with four blade-rotating gears (i.e., gears 40*a*-40*d*), rotator assembly 12 may include fewer or additional numbers of metal component-rotating gears. The number of gears that may be used is generally dictated by the size and capacity of plating bath 14 (shown in FIG. 1). Examples of suitable numbers of metal component-rotating gears for rotator assembly 12 range from one gear to 20 gears. In another alternative embodiment, one or more of the gears in the series (e.g., gears 40*a*-40*d*) may be rotated directly from motor 20, thereby omitting the need for reducing gear 38.

Cathode assembly 24 includes cathode contacts 42*a*-42*d*, current connector 44, and battery contact 46. Cathode contacts 42*a*-42*d* are conductive metal shafts that extend axially through gears 40*a*-40*d*, respectively. Cathode contacts 42*a*-42*d* are the portions of cathode assembly 24 that are in conductive contact with blades 16*a*-16*d*, respectively. Current connector 44 is a conductive metal plate that interconnects cathode contacts 42*a*-42*d* to increase the distribution of current between cathode contacts 42*a*-42*d*. In alternative embodiments, current connector 44 may be provided in other designs that provide conductive interconnections, such as chain links and wire meshes. One or more portions of cathode assembly 24 may also be encased in an electrically insulating container or wrapping to reduce the risk of shorting cathode assembly 24 during operation.

In the embodiment shown in FIG. 2, battery contact 46 is a conductive metal pad secured to current connector 44, which provides a convenient location to connect cathode assembly 24 to a negative terminal of a battery or other DC source (not shown). In alternative embodiments, battery contact 46 may be integrally formed with current connector 44 instead of being a separate piece of conductive material attached to current connector 44. When the negative terminal of a battery/DC source is connected to battery contact 46, the negative charge is applied to cathode contacts 42*a*-42*d* via current connector 44. This correspondingly places negative charges on the rotating blades 16*a*-16*d* for attracting positive-charged metallic ions during an electroplating process. As discussed above, rotating blades 16*a*-16*d* during the electroplating process increases the uniformity of the plated metal coatings formed on blades 16*a*-16*d*. Accordingly, gear assembly 22 and cathode assembly 24 provide a convenient and efficient means for rotating and placing negative charges on blades 16*a*-16*d* during the electroplating process.

Figure 3:
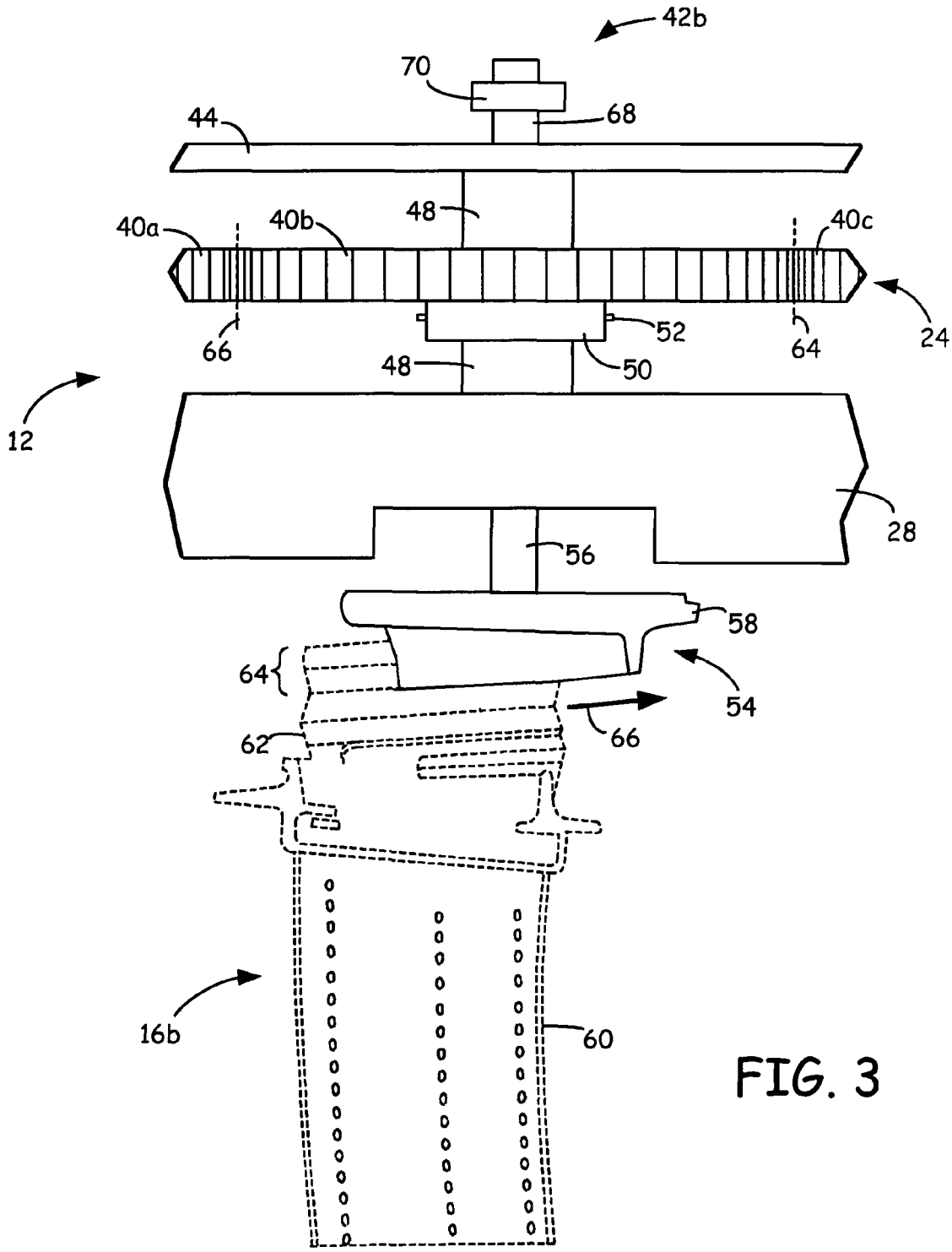
FIG. 3 is an expanded front view of a portion of the rotator assembly, showing the interconnections of a gear assembly and a cathode assembly of the rotator assembly.

FIG. 3 is an expanded front view of rotator assembly 12, further illustrating the interconnections between gear 40*b* and cathode contact 42*b*. While the following discussion refers to gear 40*b* and cathode contact 42*b*, the discussion also applies to any blade-rotating gear and conductive contact of rotator assembly 12 (e.g., gears 40*a*-40*d* and conductive contacts 42*a*-42*d*). As shown in FIG. 3, gear assembly 22 further includes bearings shaft 48, collar 50, retention pin 52, and mount assembly 54. Bearings shaft 48 extends through gear 40*b* and into base platform 28, thereby allowing base platform 28 to support bearings shaft 48. Bearings shaft 48 includes a set of bearings (not shown) that stabilize the rotation of gear 40*b* and blade 16*b*.

Collar 50 is a ring-like component integrally formed with gear 40*b*, which extends around bearings shaft 48 below gear 40*b*. Collar 50 is supported by bearings shaft 48 with retention pin 52, where retention pin 52 extends through bearings shaft 48 and collar 50. As such, gear 40*b* is vertically supported by bearings shaft 48, and the rotation of gear 40*b* correspondingly rotates bearings shaft 48. This arrangement allows gear 40*b* to be removed from bearings shaft 48 (by removing retention pin 52) for maintenance and cleaning. In an alternative embodiment, collar 50 is a separate component that is secured to gear 40*b*.

Mount assembly 54 is a conductive metal component that includes mount shaft 56 and mount block 58, where mount block 58 may be integrally formed with mount shaft 56. Mount shaft 56 is secured to bearings shaft 48 at a location within base platform 28, thereby allowing the rotation of bearings shaft 48 (via gear 40*b*) to also rotate mount assembly 54. Mount block 58 is the portion of gear assembly 24 that retains blade 16*b* during an electroplating process.

Blade 16*b* (shown with broken lines) includes airfoil 60 and blade root 62, where airfoil 60 extends from blade root 62. Blade 16*b* is retained by mount assembly 54 by sliding at least a portion of blade root 62 (referred to as portion 64) into mount block 58 (in the direction of arrow 66) until portion 64 is disposed within mount block 58. In one embodiment, mount block 58 includes a locking mechanism (not shown) to securely retain blade 16*b* during an electroplating process. While blade 16*b* is retained by mount assembly 54, the rotation of mount assembly 54 (via gear 40*b* and bearings shaft 48) correspondingly rotates blade 16*b*.

After blade 16*b* is inserted onto mount assembly 54, one or more portions of blade 16*b* may be masked to prevent the plated metallic coating from being formed on masked portions. For example, the exposed portion of root 62 may be masked to prevent the plated metallic coating from being formed on root 62. After the electroplating process is complete, blade 16*b* may be removed from mount assembly 54 by sliding root 62 out of mount block 58. Accordingly, mount assembly 54 provides a convenient arrangement for easily inserting and removing metal components between electroplating process.

As further shown in FIG. 3, cathode contact 42*b* includes conductive shaft 68 and retention nut 70. Conductive shaft 68 extends through current connector 44, bearings shaft 48, gear 40*b*, and base platform 28, and is secured to bearings shaft 48. Conductive shaft 68 also extends down within base platform 28 to contact mount shaft 56. This provides a conductive connection between current connector 44 and mount assembly 54 to place a negative charge on mount assembly 54. In an alternative embodiment, conductive shaft 68 is integrally formed with mount shaft 56. Retention nut 70 is secured to conductive shaft 68, thereby retaining current connector 44 around conductive shaft 68, between bearings shaft 48 and retention nut 70.

During operation, blade 16*b* is inserted onto mount block 58 and rotator assembly 12 is lowered into plating bath 14 (shown in FIG. 1). Because gear 40*b* and cathode contact 42*b* are disposed primarily on the top side of base platform 28, and mount assembly 54 and blade 16*b* are disposed on the bottom side of base platform 28 (i.e., adjacent opposing major surfaces of base platform 28), blade 16*b* may be immersed into plating bath 14 without immersing gear 40*b* and cathode contact 42*b*. Thus, base platform 28 provides a physical structure that prevents plating solution 32 (shown in FIG. 1) from contacting immersing gear 40*b* and cathode contact 42*b*.

Gears 40*a*-40*d* are then rotated by motor 20 (shown in FIGS. 1 and 2) and reducing gear 38 (shown in FIGS. 1 and 2). This causes gear 40*c* to rotate gear 40*b* due to the gear engagement at intersection 64. The rotation of gear 40*b* correspondingly rotates gear 40*a* due to the gear engagement at intersection 66. The rotation of gear 40*b* also rotates collar 50 and bearings shaft 48 (due to retention pin 52), which correspondingly rotates mount assembly 54 and blade 16*b*. While gear 40*b* is rotating, a negative charge is placed on conductive shaft 68 via current connector 44. Due to the conductive connections, the negative charge is thereby placed on bearings shaft 48, mount assembly 54, and blade 16*b*. Thus, this arrangement of gear assembly 22 and cathode assembly 24 allows blades 16*a*-16*d* to rotate and receive negative charges in a simultaneous manner.

Figure 4:
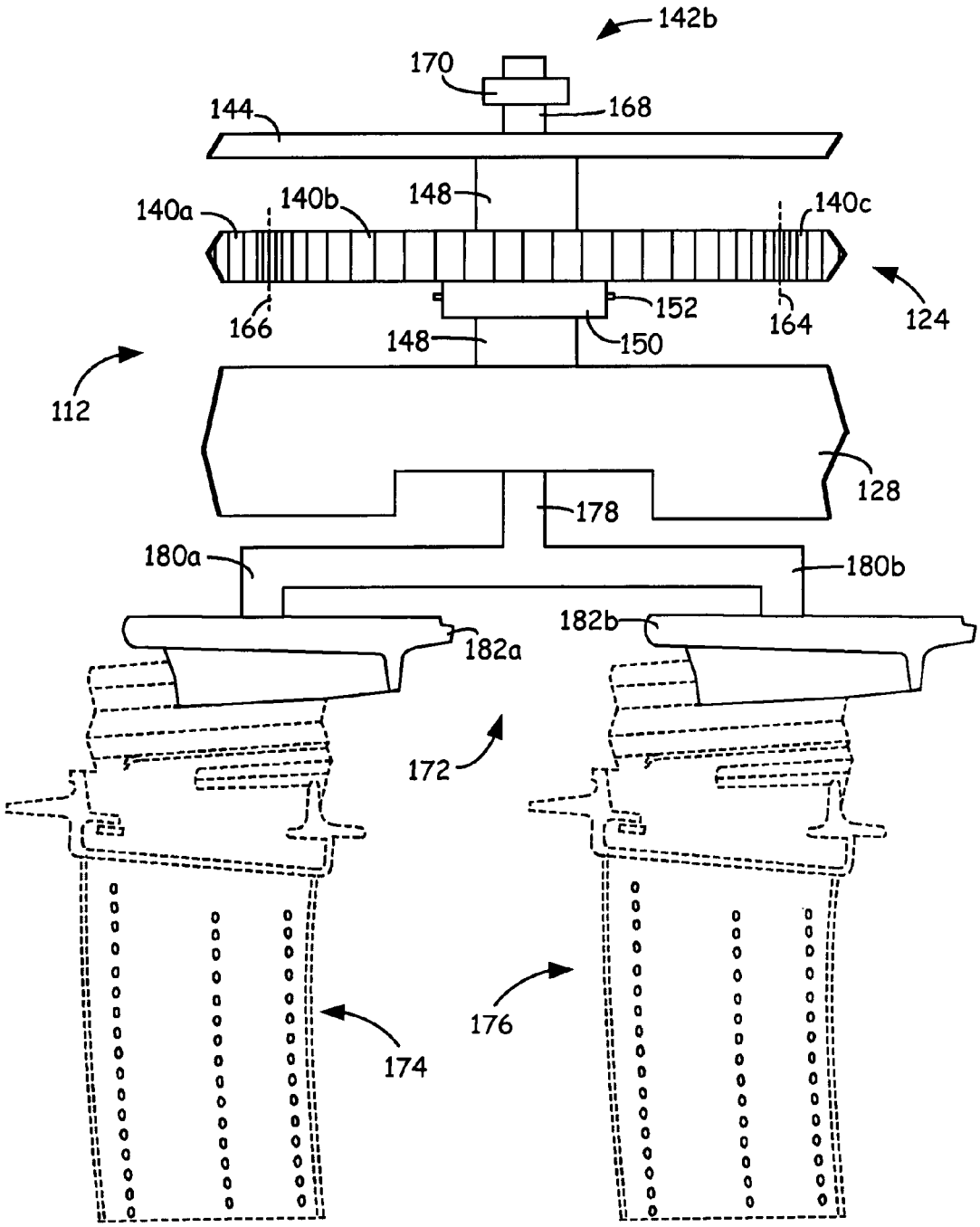
FIG. 4 is an expanded front view of a portion of an alternative rotator assembly for retaining multiple blades.

FIG. 4 is an expanded front view of rotator assembly 112, which is an alternative embodiment to rotator assembly 12 (shown in FIGS. 1-3). Rotator assembly 112 has a configuration similar to rotator assembly 12, and the respective reference labels are increased by 100. In this embodiment, mount assembly 54 of rotator assembly 12 is replaced with mount assembly 172, which allows multiple blades (e.g., blades 174 and 176 shown in FIG. 4) to be rotated with a single gear (e.g., gear 140*b*). Mount assembly 172 is a conductive metal component that includes mount shaft 178, extension members 180*a* and 180*b*, and mount blocks 182*a* and 182*b*. Extension members 180*a* and 180*b* are a pair of opposing arms interconnecting mount shaft 178 and mount blocks 182*a* and 182*b*. Mount shaft 178 is secured to bearings shaft 148 at a location within base platform 128, thereby allowing the rotation of bearings shaft 148 (via gear 140*b*) to also rotate extension members 180*a* and 180*b* and mount blocks 182*a* and 182*b*. Mount blocks 182*a* and 182*b* are the portions of gear assembly 124 that respectively retain blades 174 and 176 during an electroplating process.

Rotator assembly 112 may be used in an electroplating process in the same manner as discussed above for rotator assembly 12, where gear 140*b* rotates both blades 174 and 176. This arrangement allows a greater number of blades to be plated during a single electroplating process. While mount assembly 172 is shown with two extension members 180*a* and 180*b* and two mount blocks 182*a* and 182*b* (for retaining two blades 174 and 176), mount assembly 172 may alternatively include additional extension members and mount blocks for retaining an even greater number of blades. For example, mount assembly 172 may include four extension members and four mount blocks, which form a cross pattern from mount shaft 178, thereby allowing four blades to be retained from gear 140*b*. This further increases the number of blades that may be plated during a single electroplating process. Many other arrangements of multiple metal components for each mount assembly are also possible.

Figure 5:
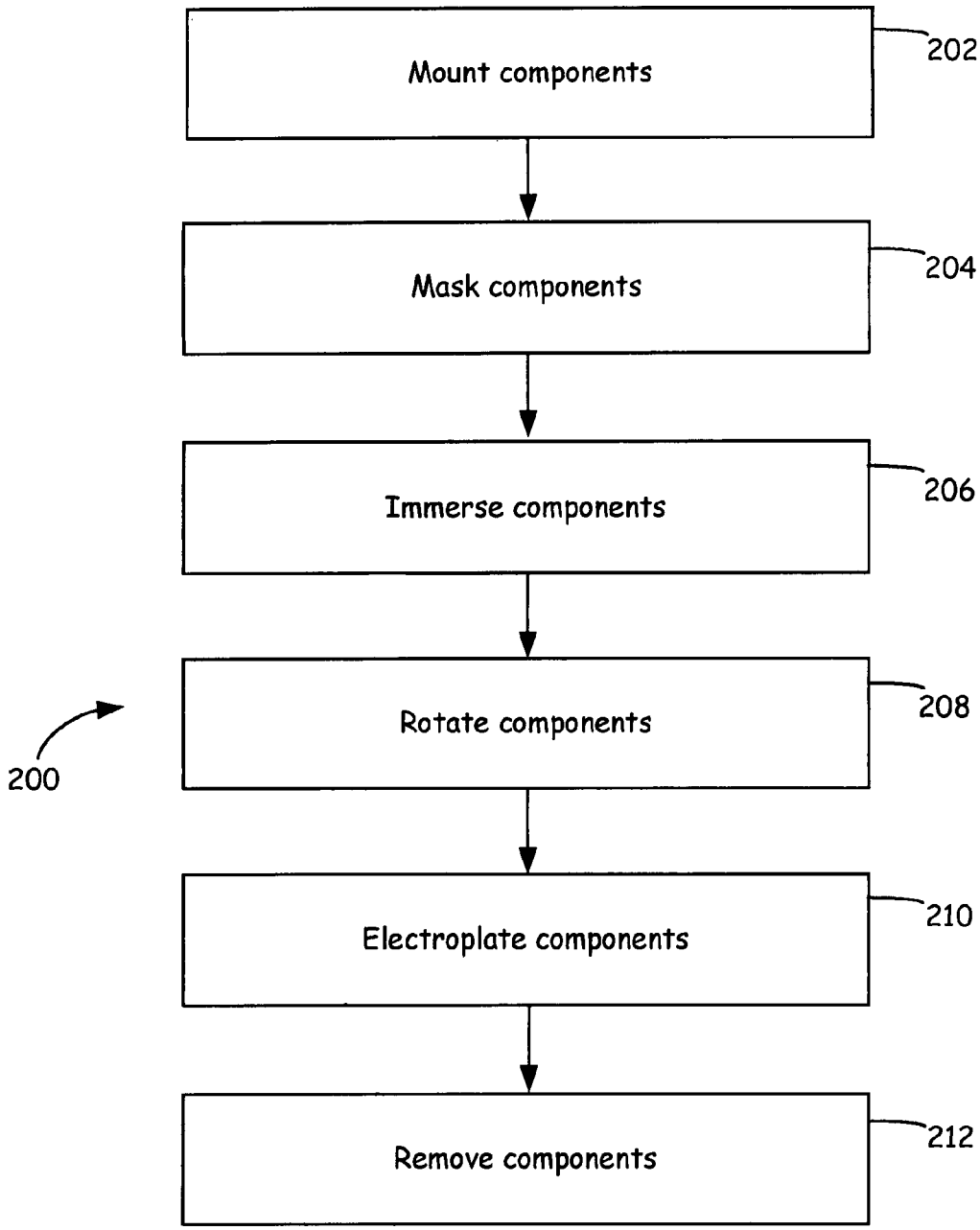
FIG. 5 is a flow diagram of a method for performing an electroplating process on a metal component with a system that rotates the metal components.

FIG. 5 is a flow diagram of method 200 for performing an electroplating process on one or more metal components with an electroplating system that rotates the metal components, such as system 10. Method 200 includes steps 202-212, and initially involves inserting one or more metal components (e.g., blades 16*a*-16*d*) onto rotatable mounts (step 202). Preferably, multiple metal components are inserted onto multiple rotatable mounts to increase the throughput of the electroplating process. One or more portions of the metal components are then optionally masked to prevent plated metallic coatings from being deposited on the masked portions (step 204). In alternative embodiments, the metal components may be masked prior to being inserted onto the rotatable mounts. The metal components are then immersed in a plating solution containing metal salts of the metal to be electroplated on the metal components (step 206).

The immersed metal components are then rotated (step 208). Each metal component is desirably rotated such that the surfaces of the given metal component face a plating bath anode for substantially the same durations. Suitable rotation speeds for the metal components include those discussed above for blades 16*a*-16*d*. In an alternative embodiment, steps 206 and 208 are performed in an opposite order, where the metal components are rotating prior to being immersed in the plating solution.

The immersed, rotating metal components are then electroplated to form metal coatings on the exposed surfaces of the metal components (step 210). This involves placing negative charges on the metal components and a positive charge on the plating anode. As discussed above, the positive charge placed on the plating anode causes the metal salts of the plating solution to disassociate to form positive-charged metallic ions. The metallic ions are attracted to the negative-charged surfaces of the rotating metal components, thereby forming metal coatings on the metal components.

The electroplating process is performed for a duration, and with a plating current magnitude, sufficient to form metal coatings of desired thicknesses on the metal components. Examples of suitable processing conditions include a duration ranging from about one hour to about two hours at a plating current ranging from about 0.1 amperes to about 0.5 amperes, with particularly suitable processing conditions including a duration of about 180 minutes at a plating current of about 0.22 amperes. When the desired metal coatings are formed, the negative and positive charges are removed from the metal components and the plating bath anode, respectively, and the metal components are removed from the plating solution (step 212). The resulting metal components may then undergo post-processing cleaning and dryings steps. Rotating the metal components during the electroplating process increases the uniformity of the deposited metal coatings without requiring manual monitoring or adjustments.

Although the present invention has been described with reference to preferred embodiments, workers skilled in the art will recognize that changes may be made in form and detail without departing from the spirit and scope of the invention.

The invention claimed is:

1. A system for electroplating a plurality of turbine blades, the system comprising:

at least one rotatable gear for each of the plurality of turbine blades;

at least one mount assembly operatively connected to the at least one rotatable gear for each of the plurality of turbine blades and configured to retain each of the plurality turbine blades, wherein the mount assembly comprises a mount shaft secured to at least one mount block; and a means for placing an electric charge on each of the plurality of turbine blades during rotation of the at least one rotatable gear.

2. The system of claim 1, wherein the mount shaft is the portion of the mount assembly that is conductively connected to the conductive contact, and wherein the at least one mount block is the portion of the mount assembly configured to retain each of the plurality of turbine blades.

3. The system of claim 1, wherein the means for placing the electric charge on each of the plurality of turbine blades comprises at least one conductive contact extending through the at least one rotatable gear.

4. The system of claim 1, further comprising a base platform, wherein the at least one rotatable gear and the at least one mount assembly are disposed adjacent opposing major surfaces of the base platform.

5. A system for electroplating a plurality of turbine blades, the system comprising:

a plurality of rotatable gears;

a plurality of mount assemblies secured to the rotatable gears and configured to retain the turbine blades wherein each mount assembly comprises a mount shaft secured to at least one mount block;

a plurality of conductive contacts conductively connected to the mount assemblies for placing an electric charge on the turbine blades during rotation of the rotatable gears; and a conductive connector interconnecting the plurality of conductive contacts.

6. The system of claim 5, further comprising a reducing gear engaged with at least one of the rotatable gears.

7. The system of claim 5, further comprising a base platform, the rotatable gears being supported by the base platform.

8. The system of claim 7, wherein the rotatable gears and the mount assemblies are disposed adjacent opposing major surfaces of the base platform.

9. A system for electroplating a plurality of turbine blades, the system comprising:

a plating bath;

a rotatable gear assembly providing a separate gear for each of the plurality of turbine blades and positioned for contact with the plating bath;

a mount assembly secured to the rotatable gear assembly and configured to retain the plurality of turbine blades during rotation of the rotatable gear assembly wherein the mount assembly comprises a mount shaft secured to at least one mount block; and a conductive contact conductively connected to the mount assembly for placing an electric charge on each of the plurality of turbine blades during rotation of the gear assembly in the plating bath.

10. The system of claim 9, further comprising a reducing gear engaged with the rotatable gear assembly.

11. The system of claim 9, wherein the conductive contact extends through the rotatable gear assembly.

12. The system of claim 9, wherein the rotatable gear assembly includes a first rotatable gear, the mount assembly is a first mount assembly, and the conductive contact is a first conductive contact, the system further comprising:

a second rotatable gear in the rotatable gear assembly engaged with the first rotatable gear;

a second mount assembly secured to the rotatable gear assembly; and a second conductive contact extending through the rotatable gear assembly and conductively connected to the second mount assembly.

13. The system of claim 9, further comprising a base platform, wherein the rotatable gear and the mount assembly are disposed adjacent opposing major surfaces of the base platform.

14. The system of claim 9, wherein the mount shaft is the portion of the mount assembly that is conductively connected to the conductive contact, and wherein the at least one mount block is the portion of the mount assembly configured to retain the plurality of turbine vanes.

15. A method of electroplating a plurality of turbine blades, the method comprising:

inserting each of the plurality of turbine blades onto at least one mount assembly, wherein the mount assembly comprises a mount shaft secured to at least one mount block;

at least partially immersing the plurality of turbine blades in a plating solution;

rotating the plurality of turbine blades, wherein the plurality of turbine blades is rotatably connected to a plurality of rotatable gears;

placing a negative charge on the plurality of turbine blades; and placing a positive charge on an anode in contact with the plating solution, thereby allowing metallic ions from the plating solution to deposit onto the plurality of turbine blades while the plurality of turbine blades is rotating.

16. The method of claim 15, wherein rotating the plurality of turbine blades comprises rotating a reducing gear engaged with the plurality of rotatable gears.

17. The method of claim 15, further comprising masking at least a portion of the plurality of turbine blades.

* * * * *

UNITED STATES PATENT AND TRADEMARK OFFICE

CERTIFICATE OF CORRECTION

PATENT NO. : 7,854,830 B2
APPLICATION NO. : 11/788609
DATED : December 21, 2010
INVENTOR(S) : Garimella Balaji Rao et al.

It is certified that error appears in the above-identified patent and that said Letters Patent is hereby corrected as shown below:

Column 9, line 5, delete “vanes” and insert --blades--.

Signed and Sealed this
Fifteenth Day of March, 2011

David J. Kappos

David J. Kappos
*Director of the United States Patent and Trademark Office*